US007914963B2

(12) United States Patent
Fields et al.

(10) Patent No.: US 7,914,963 B2
(45) Date of Patent: Mar. 29, 2011

(54) TONER COMPOSITION

(75) Inventors: Robert D. Fields, Rochester, NY (US); Charles T. Havens, Churchville, NY (US); Peter S. Alexandrovich, Rochester, NY (US); Dinesh Tyagi, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 581 days.

(21) Appl. No.: 11/954,424

(22) Filed: Dec. 12, 2007

(65) Prior Publication Data

US 2009/0155704 A1 Jun. 18, 2009

(51) Int. Cl.
*G03G 9/00* (2006.01)

(52) U.S. Cl. ..... 430/108.8

(58) Field of Classification Search ..... 430/108.8
See application file for complete search history.

(56) References Cited

U.S. PATENT DOCUMENTS

| | | | | |
|---|---|---|---|---|
| 3,893,935 | A | 7/1975 | Jadwin et al. | |
| 3,938,992 | A | 2/1976 | Jadwin et al. | |
| RE31,072 | E | 11/1982 | Jadwin et al. | |
| 4,414,152 | A | 11/1983 | Santilli et al. | |
| 4,416,965 | A | 11/1983 | Sandhu et al. | |
| 4,430,408 | A | 2/1984 | Sitaramiah | |
| 4,546,060 | A | 10/1985 | Miskinis et al. | |
| 4,624,907 | A | 11/1986 | Niimura et al. | |
| 4,683,188 | A | 7/1987 | Suzuki et al. | |
| 4,780,553 | A | 10/1988 | Suzuki et al. | |
| 4,865,937 | A | 9/1989 | Santilli et al. | |
| 5,112,715 | A | 5/1992 | DeMejo et al. | |
| 5,147,747 | A | 9/1992 | Wilson et al. | |
| 5,176,980 | A | 1/1993 | Santilli et al. | |
| 5,714,295 | A | 2/1998 | Wilson et al. | |
| 2004/0265729 | A1 * | 12/2004 | Patel | 430/137.14 |
| 2005/0048389 | A1 | 3/2005 | Cheng et al. | |
| 2007/0141500 | A1 * | 6/2007 | Sugimoto et al. | 430/110.3 |

FOREIGN PATENT DOCUMENTS

| | | |
|---|---|---|
| EP | 0 062 482 | 10/1982 |

* cited by examiner

*Primary Examiner* — Mark A Chapman
(74) *Attorney, Agent, or Firm* — Carl F. Ruoff; Andrew J. Anderson

(57) ABSTRACT

The present invention is a toner that includes a polymeric binder and a polyethylene wax or ester wax. A dispersing agent of poly(ethylene vinyl acetate) is included in the toner that dispersed the wax and reduces the amount of free wax particles.

13 Claims, 1 Drawing Sheet

TONER COMPOSITION

FIELD OF THE INVENTION

The present invention relates in general to electrostatographic imaging and, more particularly, to polymeric toner particles suitable for use in oil-less fusing electrostatographic machines.

BACKGROUND OF THE INVENTION

The present invention relates to toners and development systems for toners.

Electrophotographic (EP) toners that contain low molecular weight polyolefin waxes have improved fusing properties when compared to toners that do not contain wax. Such toners have a wider range of fusing temperatures and are more robust to fusing hot offset. A critical problem with such toners is that they are made by melt compounding, pulverizing, and classifying and can contain a mixture of toners particles and wax particles. The wax particles can create print image artifacts by contaminating the EP photoconductor and toner transfer rollers. Toners that include wax, but have a very low level of wax particles do not show image defects. This present invention provides a solution to this problem through a novel composition.

SUMMARY OF THE INVENTION

The present invention is a toner that includes a polymeric binder and a polyethylene wax or ester wax. A dispersing agent of poly(ethylene vinyl acetate) is included in the toner that dispersed the wax and reduces the amount of free wax particles.

ADVANTAGEOUS EFFECT OF THE INVENTION

The present invention solves the problem of compounding or pulverizing toners that contain wax by using a toner that is made from a polymeric binder, polyethylene wax, and a poly (ethylene vinyl acetate). The melt blend of these three polymers forms a miscible phase. A blend of only polyester binder and polyethylene wax has a higher level of an immiscible wax phase. As a result there is a reduction in the level of wax particles in the toner.

Figure 1:
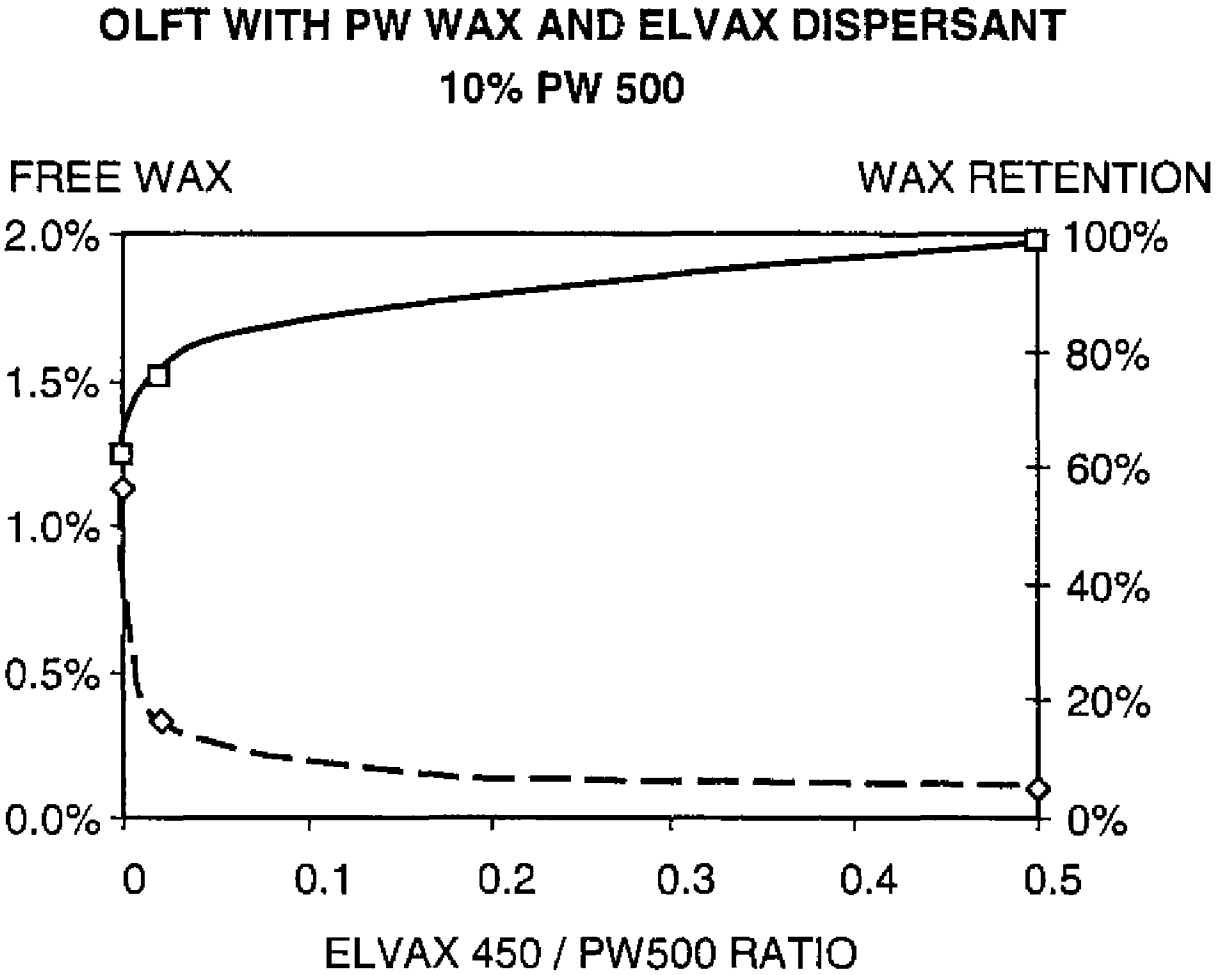
FIG. 1 shows the effect of the EVA/Wax ratio on percent wax retention and free wax level in toners of the present invention.

For a better understanding of the present invention together with other advantages and capabilities thereof, reference is made to the following description and appended claims in connection with the preceding drawings.

DETAILED DESCRIPTION OF THE INVENTION

The present invention relates to toner particles and toner formulations that contains a polymeric toner resin, a polyethylene wax or ester wax and as a dispersant ethylene vinyl acetate.

The toner formulations of the present invention can be used in single component toners or two component toner systems. Preferably, the toner formulations of the present invention are used in two component toner/developer systems.

In the present invention, one or more polyester toner resins are present in the toner particles or toner formulations of the present invention. The toner particles can be any conventional size and preferably have a median volume diameter of from about 6 microns or less to about 12 microns.

The toner particles can include one or more polyester toner resins which can be optionally colored by one or more colorants by compounding the resin(s) with at least one colorant and any other ingredients. Although coloring is optional, normally a colorant is included and can be any of the materials mentioned in Colour Index, Volumes I and II, Second Edition, incorporated herein by reference. The toner resin can be selected from a wide variety of materials including both natural and synthetic resins and modified natural resins as disclosed, for example, in U.S. Pat. Nos. 4,076,857; 3,938,992; 3,941,898; 5,057,392; 5,089,547; 5,102,765; 5,112,715; 5,147,747; 5,780,195 and the like, all incorporated herein by reference. Preferred resin or binder materials include polyesters. The shape of the toner particles can be any shape, regular or irregular, such as spherical particles, which can be obtained by spray-drying a solution of the toner resin in a solvent. Alternatively, spherical particles can be prepared by the polymer bead swelling techniques, such as those described in European Patent No. 3905 published Sep. 5, 1979, which is incorporated in its entirety by reference herein.

Typically, the amount of toner resin present in the toner formulation is from about 85 to about 95.

In a typical manufacturing process, the desired polymeric binder for toner application is produced. Polymeric binders for electrostatographic toners are commonly made by polymerization of selected monomers followed by mixing with various additives and then grinding to a desired size range. During toner manufacturing, the polymeric binder is subjected to melt processing in which the polymer is exposed to moderate to high shearing forces and temperatures in excess of the glass transition temperature of the polymer. The temperature of the polymer melt results, in part, from the frictional forces of the melt processing. The melt processing includes melt-blending of toner addenda into the bulk of the polymer.

Useful binder polymers (or toner resins) include vinyl polymers, such as homopolymers and copolymers of styrene. Styrene polymers include those containing 40 to 100 percent by weight of styrene, or styrene homologs, and from 0 to 40 percent by weight of one or more lower alkyl acrylates or methacrylates. Other examples include fusible styrene-acrylic copolymers that are covalently lightly crosslinked with a divinyl compound such as divinylbenzene. Binders of this type are described, for example, in U.S. Reissue Pat. No. 31,072, which is incorporated in its entirety by reference wherein. Preferred binders comprise styrene and an alkyl acrylate and/or methacrylate and the styrene content of the binder is preferably at least about 60% by weight.

Copolymers rich in styrene such as styrene butylacrylate and styrene butadiene are also useful as binders as are blends of polymers. In such blends, the ratio of styrene butylacrylate to styrene butadiene can be 10:1 to 1:10. Ratios of 5:1 to 1:5 and 7:3 are particularly useful. Polymers of styrene butylacrylate and/or butylmethacrylate (30 to 80% styrene) and styrene butadiene (30 to 80% styrene) are also useful binders.

Styrene polymers include styrene, alpha-methylstyrene, para-chlorostyrene, and vinyl toluene; and alkyl acrylates or methylacrylates or monocarboxylic acids having a double bond selected from acrylic acid, methyl acrylate, 2-ethylhexyl acrylate, 2-ethylhexyl methacrylate, ethyl acrylate, butyl acrylate, dodecyl acrylate, octyl acrylate, phenylacrylate, methylacrylic acid, ethyl methacrylate, butyl methacrylate and octyl methacrylate and are also useful binders.

Also useful as the polymeric binder are condensation polymers such as polyesters and copolyesters of aromatic dicarboxylic acids with one or more aliphatic diols, such as polyesters of isophthalic or terephthalic acid with diols such as ethylene glycol, cyclohexane dimethanol, and bisphenols. Other useful resins include polyester resins, such as by the co-polycondensation polymerization of a carboxylic acid component comprising a carboxylic acid having two or more valencies, an acid anhydride thereof or a lower alkyl ester thereof (e.g., fumaric acid, maleic acid, maleic anhydride, phthalic acid, terephthalic acid, trimellitic acid, or pyromellitic acid), using as a diol component a bisphenol derivative or a substituted compound thereof. Specific examples are described in U.S. Pat. Nos. 5,120,631; 4,430,408; and 5,714,295, all incorporated herein by reference, and include propoxylated bisphenol—A fumarate, such as Finetone® 382 ES from Reichold Chemicals, formerly Atlac® 382 ES from ICI Americas Inc.

A useful polymeric binder can also be formed from a copolymer of a vinyl aromatic monomer; a second monomer selected from either conjugated diene monomers or acylate monomers such as alkyl acrylate and alkyl methacrylate.

With respect to the polyethylene wax, it is preferred that the melting point is greater than 50° C. and the melting peak is below 100° C. Fractionated polyethylenes, PW-1197 and PW-1214, and the ester wax WEP3 are identified as suitable waxes for the present invention.

The amount of the wax that is present in the toner formulations of the present invention can be any suitable amount to accomplish the benefits mentioned herein. Examples of suitable amounts include, but are not limited to, from about 0.1 to about 10 weight percent and more preferably from about 1 to about 6 weight percent based on the toner weight. Other suitable amounts are from about 1 part to about 5 parts based on a 100 parts by weight of the toner resin present.

The following discussion relates to optional components that can also be present in the toner particles or formulations of the present invention.

The wax dispersant ethylene vinyl acetate (EVA) is soluble in both the polyester binder and the wax. This improves the solubility of the wax in the polyester binder. It has been shown that waxes that are not compatible with the polyester binder and form separate domains. Wax domains can become separate particles during the toner pulverizing and classification process. The result is a toner with low wax content, a significant number of free wax particles, or both.

As indicated above, at least one charge control agent can be present in the toner formulations of the present invention. The term "charge-control" refers to a propensity of a toner addendum to modify the triboelectric charging properties of the resulting toner. A very wide variety of charge control agents for positive and negative charging toners are available. Suitable charge control agents are disclosed, for example, in U.S. Pat. Nos. 3,893,935; 4,079,014; 4,323,634; 4,394,430; and GB Patent Nos. 1,501,065 and 1,420,839, all of which are incorporated in their entireties by reference herein. Additional charge control agents which are useful are described in U.S. Pat. Nos. 4,624,907; 4,814,250; 4,840,864; 4,834,920; 4,683,188; and 4,780,553, all of which are incorporated in their entireties by reference herein. Mixtures of charge control agents can also be used. Particular examples of charge control agents include chromium salicylate organo-complex salts, and azo-iron complex-salts, an azo-iron complex-salt, particularly ferrate (1-), bis[4-[(5-chloro-2-hydroxyphenyl) azo]-3-hydroxy-N-phenyl-2-naphthalenecar-boxamidato (2-)], ammonium, sodium, and hydrogen (Organoiron available from Hodogaya Chemical Company Ltd.).

Additional examples of suitable charge control agents include, but are not limited to, acidic organic charge control agents. Particular examples include, but are not limited to, 2,4-dihydro-5-methyl-2-phenyl-3H-pyrazol-3-one (MPP) and derivatives of MPP such as 2,4-dihydro-5-methyl-2-(2,4,6-trichlorophenyl)-3H-pyrazol-3-one, 2,4-dihydro-5-methyl-2-(2,3,4,5,6-pentafluorophenyl)-3H-pyrazol-3-one, 2,4-dihydro-5-methyl-2-(2-trifluoromethylphenyl)-3H-pyrazol-3-one and the corresponding zinc salts derived therefrom. Other examples include charge control agents with one or more acidic functional groups, such as fumaric acid, malic acid, adipic acid, terephathalic acid, salicylic acid, fumaric acid monoethyl ester, copolymers of styrene/methacrylic acid, copolymers of styrene and lithium salt of methacrylic acid, 5,5'-methylenedisalicylic acid, 3,5-di-t-butylbenzoic acid, 3,5-di-t-butyl-4-hydroxybenzoic acid, 5-t-octylsalicylic acid, 7-t-butyl-3-hydroxy-2-napthoic acid, and combinations thereof. Still other acidic charge control agents which are considered to fall within the scope of the invention include N-acylsulfonamides, such as, N-(3,5-di-t-butyl-4-hydroxybenzoyl)-4-chlorobenzenesulfonamide and 1,2-benzisothiazol-3(2H)-one 1,1-dioxide.

Another class of charge control agents include, but are not limited to, iron organo metal complexes such as organo iron complexes. A particular example is T77 from Hodogaya.

Preferably, the charge control agent is capable of providing a consistent level of charge. For purposes of the present invention, a preferred consistent level of charge is from about −10 to about −30 micro C/gm. The toner Q/m ratio can be measured in a MECCA device comprised of two spaced-apart, parallel, electrode plates which can apply both an electrical and magnetic field to the developer samples, thereby causing a separation of the two components of the mixture, i.e., carrier and toner particles, under the combined influence of a magnetic and electric field. A 0.100 g sample of a developer mixture is placed on the bottom metal plate. The sample is then subjected for thirty (30) seconds to a 60 Hz magnetic field and potential of 2000 V across the plates, which causes developer agitation. The toner particles are released from the carrier particles under the combined influence of the magnetic and electric fields and are attracted to and thereby deposit on the upper electrode plate, while the magnetic carrier particles are held on the lower plate. An electrometer measures the accumulated charge of the toner on the upper plate. The toner Q/m ratio in terms of microcoulombs per gram (μC/g) is calculated by dividing the accumulated charge by the mass of the deposited toner taken from the upper plate. In order to correctly predict the effect of toner formulation on charge with developer life, a developer at 20 percent toner concentration is first prepared. The developer is then allowed to exercise in the presence of a development roller in which the core is rotating at 2000 rpm. After 1 hour of exercise, the developer is removed and the toner is separated from the carrier by exposing the developer to high voltage of opposite polarity to toner. The stripped carrier is then rebuilt with fresh toner at 10 percent toner concentration. The developer is first wrist shaken for 2 minutes and "Fresh" charge is measured using the MECCA device. This developer is then placed on a magnetic roller where it is exercised for 10 minutes with magnetic core rotating at 200 rpm. The "Aged" charged is measured again using MECCA.

The charge control agent(s) is generally present in the toner formulation in an amount to provide a consistent level of charge and preferably provide a consistent level of charge of from about −10 to about −30 μC/gm in the toner formulation upon being charged. Examples of suitable amounts include from about ½ part to about 6 parts per 100 parts of resin present in the toner formulation.

With respect to the surface treatment agent, also known as a spacing agent, the amount of the agent on the toner particles is an amount sufficient to permit the toner particles to be stripped from the carrier particles in a two component system by the electrostatic forces associated with the charged image or by mechanical forces. Preferred amounts of the spacing agent are from about 0.05 to about 1.5 weight percent, and more preferably from about 0.1 to about 1.0 weight percent, and most preferably from about 0.2 to 0.6 weight percent, based on the weight of the toner.

The spacing agent can be applied onto the surfaces of the toner particles by conventional surface treatment techniques such as, but not limited to, conventional powder mixing techniques, such as tumbling the toner particles in the presence of the spacing agent. Preferably, the spacing agent is distributed on the surface of the toner particles. The spacing agent is attached onto the surface of the toner particles and can be attached by electrostatic forces or physical means or both. With mixing, preferably uniform mixing is preferred and achieved by such mixers as a high energy Henschel-type mixer is sufficient to keep the spacing agent from agglomerating or at least minimizes agglomeration. Furthermore, when the spacing agent is mixed with the toner particles in order to achieve distribution on the surface of the toner particles, the mixture can be sieved to remove any agglomerated spacing agent or agglomerated toner particles. Other means to separate agglomerated particles can also be used for purposes of the present invention.

The preferred spacing agent is silica, such as those commercially available from Degussa, like R-972, or from Wacker, like H2000. Other suitable spacing agents include, but are not limited to, other inorganic oxide particles and the like. Specific examples include, but are not limited to, titania, alumina, zirconia, and other metal oxides; and also polymer beads preferably less than 1 μm in diameter (more preferably about 0.1 μm), such as acrylic polymers, silicone-based polymers, styrenic polymers, fluoropolymers, copolymers thereof, and mixtures thereof. These metal oxide particles can be optionally treated with a silane or silicone coating to alter their hydrophobic character.

When the toner formulation of the present invention is used in a two-component toner, the carrier particles used in association with the toner formulation can be conventional carrier particles. Thus, the carrier particles can be hard or soft magnetic carrier particles.

In more detail, the set up of the development system is preferably a digital printer, such as a Heidelberg Digimaster 9110 printer using a development station comprising a non-magnetic, cylindrical shell, a magnetic core, and means for rotating the core and optionally the shell as described, for instance, in detail in U.S. Pat. Nos. 4,473,029 and 4,546,060, both incorporated in their entirety herein by reference. The development systems described in these patents can be adapted for use in the present invention. In more detail, the development systems described in these patents preferably use hard magnetic carrier particles. For instance, the hard magnetic carrier particles can exhibit a coercivity of at least about 300 gauss when magnetically saturated and also exhibit an induced magnetic moment of at least about 20 EMU/gm when in an externally applied field of 1,000 gauss. The magnetic carrier particles can be binder-less carriers or composite carriers. Useful hard magnetic materials include ferrites and gamma ferric oxide. Preferably, the carrier particles are composed of ferrites, which are compounds of magnetic oxides containing iron as a major metallic component. For example, compounds of ferric oxide, $Fe_2O_3$, formed with basic metallic oxides such as those having the general formula $MFeO_2$ or $MFe_2O_4$ wherein M represents a mono- or di-valent metal and the iron is in the oxidation state of +3. Preferred ferrites are those containing barium and/or strontium, such as $BaFe_{12}O_{19}$, $SrFe_{12}O_{19}$, and the magnetic ferrites having the formula $MO.6\ Fe_2O_3$, wherein M is barium, strontium, or lead as disclosed in U.S. Pat. No. 3,716,630 which is incorporated in its entirety by reference herein. The size of the magnetic carrier particles useful in the present invention can vary widely, and preferably have an average particle size of less than 100 microns, and more preferably have an average carrier particle size of from about 5 to about 45 microns.

An optional additive for the toner is a colorant. In some cases the magnetic component, if present, acts as a colorant negating the need for a separate colorant. Suitable dyes and pigments are disclosed, for example, in U.S. Reissue Pat. No. 31,072 and in U.S. Pat. Nos. 4,416,965 and 4,414,152, all incorporated in their entireties by reference herein. One particularly useful colorant for toners to be used in black and white electrostatographic copying machines and printers is carbon black. Colorants are generally employed in the range of from about 1 to about 30 weight percent on a total toner powder weight basis, and preferably in the range of about 2 to about 15 weight percent. The toner formulations can also contain other additives of the type used in conventional toners, including magnetic pigments, colorants, leveling agents, surfactants, stabilizers, and the like.

The remaining components of toner particles as well as the hard magnetic carrier particles can be conventional ingredients. For instance, various resin materials can be optionally used as a coating on the hard magnetic carrier particles, such as fluorocarbon polymers like poly (tetrafluoro ethylene), poly(vinylidene fluoride) and poly(vinylidene fluoride-co-tetrafluoroethylene). Examples of suitable resin materials for the carrier particles include, but are not limited to, silicone resin, fluoropolymers, polyacrylics, polymethacrylics, copolymers thereof, and mixtures thereof, other commercially available coated carriers, and the like.

The toner formulations of the present invention can also be used in magnetic image character recognition (MICR). In such an application, the amount of the magnetic material in the toner particles of the present invention can be any amount sufficient to preferably meet commercial needs, such as providing a sufficient signal strength for the toners developed as an image. Preferably, the amount of magnetic loading in the toner compositions is from about 40% to about 50% by weight of the toner particles, and more preferably from about 42% to about 45% by weight of the toner particles. The toner preferably comprises, based on the weight of the toner, from about 40 to about 60 wt % polymer; from about 30 to about 55 wt % magnetic additive or material; optionally from about 1 to about 5 wt % release agent; and the preferred concentrations of silicon dioxide described above, all based on the weight of the toner.

The present invention further relates to methods of forming images using the toners and developers of the present invention. Generally, the method includes forming an electrostatic latent image on a surface of an electrophotographic element and developing the image by contacting the latent image with the toner/developer of the present invention.

The present invention further relates to the use of the above-described development system in developing electrostatic images with the toner of the present invention. The method involves contacting an electrostatic image with the toner of the present invention. For example, the method involves developing an electrostatic image member bearing an electrostatic image pattern by moving the image member through a development zone and transporting developer through the development zone in developing relation with the charge pattern of the moving imaging member by rotating an alternating-pole magnetic core of a pre-selected magnetic field strength within an outer non-magnetic shell, which can be rotating or stationary, and controlling the directions and speeds of the core and optionally the shell rotations so that developer flows through the development zone in a direction co-current with the image member movement, wherein an electrographic two-component dry developer composition is preferably used. The dry developer composition contains charged toner particles and oppositely charged carrier particles. The carrier particles are preferably a hard magnetic material exhibiting a coercivity of at least about 300 gauss when magnetically saturated and also exhibit an induced magnetic moment of at least about 20 EMU/gm when in an externally applied field of 1,000 gauss. The carrier particles have a sufficient magnetic moment to prevent the carrier particle from transferring to the electrostatic image. The various methods described in U.S. Pat. Nos. 4,473,029 and 4,546,060 can be used in the present invention using the toner of the present invention in the manners described herein, and these patents are incorporated in their entirety by reference herein.

The electrostatic image so developed can be formed by a number of methods such as by imagewise photodecay of a photoreceptor or imagewise application of a charge pattern on the surface of a dielectric recording element. When photoreceptors are used, such as in high-speed electrophotographic copy devices, the use of half-tone screening to modify an electrostatic image is particularly desirable; the combination of screening with development in accordance with the method of the present invention producing high-quality images exhibiting high Dmax and excellent tonal range. Representative screening methods include those employing photoreceptors with integral half-tone screen, such as those described in U.S. Pat. No. 4,385,823, incorporated in its entirety by reference herein.

Developers in the development system of the present invention are preferably capable of delivering toner to a charged image at high rates and hence are particularly suited to high-volume electrophotographic printing applications and copying applications.

The present invention can be further clarified by the following examples, which are intended to be purely exemplary of the present invention.

Free Wax and Wax Retention

Free wax particles are formed in the pulverizing process. Fracture occurring at the binder—wax domain interface will split out free wax particles. Free wax particles that are larger than the aim Dv can be pulverized until their size matches the toner size. This is undesirable as the particles are not removed in classification and the product will have a high free wax level. Small wax domains will remain in the toner-wax matrix and if the particles fracture into discrete free wax particles they can be removed by fines classification. The goal is have wax domains significantly smaller than the toner particle to achieve a product with high wax retention and low free wax.

The addition of ethyl vinyl acetate (Elvax 450) had a major effect on wax retention and free wax levels when used in pilot lab scale toner manufacturing. As little as 2 parts EVA/100 part PW500 had a major effect on the toner free wax level, FIG. 1 and Table 1.

TABLE 1

Wax retention and free wax for Polywax 500 EVA polyester toners

| Toner | PW Type | PW 500 % of Poly | Elvax Type | Elvax/PW Ratio | Q DSC ΔH | CI DSC ΔH | Wax Retention Wt % | Free Wax Wt % |
|---|---|---|---|---|---|---|---|---|
| Comparative Example 1 | 500 | 10% | 450 | 0 | 16.5 | 10.24 | 61.8% | 1.125% |
| Example 1 | 500 | 10% | 450 | 1.9 | 14.8 | 11.19 | 75.6% | 0.327% |
| Example 2 | 500 | 5% | 450 | 10.0 | 7.64 | 6.87 | 89.9% | 0.154% |
| Example 3 | 500 | 5% | 450 | 20.0 | 6.86 | 6.18 | 90.2% | 0.126% |

Toner up to 50 parts Elvax/100 parts wax were made and resulted in slight reduction in toner free wax over 10 pph. In printer and off-line fusing tests the toners made at the highest Elvax levels showed fusing failures that were caused by the Elvax and a shift in polymer rheology. Given these results a working level of 2 to 10 pph dispersant was used.

Elvax 450 was evaluated in toners that used the aliphatic ester wax WEP3 wax instead of PW500. A set of toners with variable Elvax and ester wax levels was made roll milling. The results were different than the results for PW500 based toners.

The free wax level for toners with an ester wax are lower than those made with a polyethylene wax. The PW500 toners had free wax values of 0.5 to 1.5% without Elvax, while the WEP3 wax toners were less than 1% free wax. The effect of Elvax on the free wax level for ester wax toners shows an improvement (Example 4) of using the poly(ethylene vinyl acetate to lower free wax (Comparative Example 2).

TABLE 2

Wax retention and free wax for Ester Wax EVA polyester toners

| Reference | Wax Type | Wax % | Elvax/Wax pph × 100 | DSC Coarse Grind J/gm | DSC Classified J/gm | Wax Retained % Classified/ Coarse Grind DSC | Free Wax Cl Grind % |
|---|---|---|---|---|---|---|---|
| Example 4 | WEP3 | 5% | 10.0 | 8.64 | 6.050 | 70.0% | 0.039% |
| Comparative Example 2 | WEP3 | 5% | 0 | 8.686 | 6.248 | 71.9% | 0.775% |

The invention has been described with reference to a preferred embodiment. However, it will be appreciated that variations and modifications can be effected by a person of ordinary skill in the art without departing from the scope of the invention.

The invention claimed is:

1. A toner comprising pulverized toner particles comprising a polymeric binder, polyethylene wax and poly(ethylene vinyl acetate), wherein the wax comprises from 1 to 6 weight percent of the toner, the toner comprising from 2 to 10 parts poly(ethylene vinyl acetate) per 100 parts wax, and wherein free wax particles comprise less than 0.5 weight percent of the toner.

2. The toner of claim 1 wherein the polyethylene wax comprises a melting point greater than 50° C. and a melting peak below 100° C.

3. The toner of claim 1 wherein the polymeric binder comprises at least one of vinyl polymers, polyesters, copolyesters of aromatic dicarboxylic acids with one or more aliphatic diols, and polyester resins.

4. The toner of claim 1 further comprising charge control agents.

5. The toner of claim 1 further comprising colorants.

6. The toner of claim 1 further comprising spacing agents.

7. The toner of claim 1 wherein the polymeric binder comprises a polyester resin.

8. The toner of claim 1 wherein the toner particles have a median volume diameter of from 6 to 12 microns.

9. A toner comprising pulverized toner particles comprising a polymeric binder, polyethylene wax or ester wax, and poly(ethylene vinyl acetate), wherein the wax comprises from 1 to 6 weight percent of the toner, the toner comprising from 2 to 10 parts poly(ethylene vinyl acetate) per 100 parts wax, and wherein free wax particles comprise less than 0.5 weight percent of the toner.

10. The toner of claim 9 wherein the polymeric binder comprises at least one of vinyl polymers, polyesters, copolyesters of aromatic dicarboxylic acids with one or more aliphatic diols, and polyester resins.

11. The toner of claim 9 wherein the wax comprises an ester wax.

12. The toner of claim 9 wherein the polymeric binder comprises a polyester resin.

13. The toner of claim 9 wherein the toner particles have a median volume diameter of from 6 to 12 microns.

* * * * *